United States Patent [19]

Murray

[11] 4,177,929

[45] Dec. 11, 1979

[54] FLIP-TOP CAN CONSTRUCTION

[76] Inventor: John C. Murray, R.D. #1, Broad Top, Pa. 16621

[21] Appl. No.: 956,949

[22] Filed: Nov. 2, 1978

[51] Int. Cl.[2] ..... B65D 41/32
[52] U.S. Cl. ..... 220/270; 220/379
[58] Field of Search ..... 220/270, 85 CH, 379

[56] References Cited

U.S. PATENT DOCUMENTS

| | | | |
|---|---|---|---|
| 1,507,693 | 9/1924 | Smith, Jr. | 220/379 X |
| 3,727,790 | 4/1973 | Bly | 220/270 X |

*Primary Examiner*—George T. Hall
*Attorney, Agent, or Firm*—Wolder, Gross & Yavner

[57] ABSTRACT

A can for soda, beer, or the like, having a standard flip-top lid segment, an upstanding flange, surrounding the lid and a disposal opening defined by the flange for securing the lid segment after its removal.

5 Claims, 3 Drawing Figures

FLIP-TOP CAN CONSTRUCTION

This invention relates primarily to can construction and more particularly to can constructions of the type having removable lid segments.

Soda or beer cans with removable lid segments fall into two general categories today. The first is the most widely used and is the one which specifically relates to the improvement of the present invention. Its construction features thin sheet rolled steel stock for the main cylindrical body and an aluminum top lid portion with a removably attached lid segment roughly in the shape of a figure eight. One half of the segment is formed as an integral part of the lid portion, and is of smaller outside dimensions than the other half. The smaller half is formed to fit into a similarly shaped opening in the lid portion and coplanar therewith. The other half is rolled into a center opening handle form and secured to the first half by a rivet, or the like. By lifting the handle half by placing a finger through its opening, the first half, which is integral with the lid portion, but scored around its periphery, is easily removed and the sealed condition of the can thereby broken. However, with this category of can construction, a very significant problem occurs. The removed lid segment (attached handle and first half) is harmful, since the environment is being literally destroyed by the separate discarding of lid segments on beaches, roads and parks and the construction thereby potentially hazardous to others.

In order to overcome the above drawbacks, a second generation or category of "flip-top" cans came into being. Briefly, this second category comprises a similar lid portion with a lid segment having two halves, the first a handle and the second a plunging piece. The two halves are rather rigidly attached, so that a lifting of the handle causes the plunging piece (attached in a similar fashion to the lid portion as was described with respect to the first category of construction) to plunge into the can. After this, the segment construction allows the handle to be placed back into a coplanar orientation with the lid portion, independently with respect to the plunging piece, which stays in the can. The problem with this second category of construction relates to health considerations. These cans remain on store shelves for long periods of time before sale, and are otherwise exposed to dirt and dust, especially on the lid portion, which faces upwardly. This means that the plunger piece is dirty when it is plunged into the can and its contents.

Accordingly, a primary object of the present invention is to provide a can construction which is safe and harmless to the environment.

A further and more particular object is to provide a sanitary such construction.

These and other objects of the present invention are accomplished in a construction which features a lid portion for a can having an upstanding peripheral lip. The lid portion has attached to it a lid segment including a "figure eight" shaped assembly comprising two halves, the first of which is smaller and fits removably into a similarly shaped opening in the lid portion and the second of which is a handle riveted to the first half and larger. A rectangular opening is provided in the upstanding lip, and is used to insert therethrough the lid segment after it is removed from the lid portion of the can. The two halves of the lid segment are then crimped together to secure the lid segment during emptying of the contents of the can by drinking or pouring therefrom.

Other objects, features and advantages of the present invention will become apparent from the following more detailed description of a preferred, but nonetheless illustrative, embodiment thereof with reference to the accompanying drawings, wherein.

Figure 1:
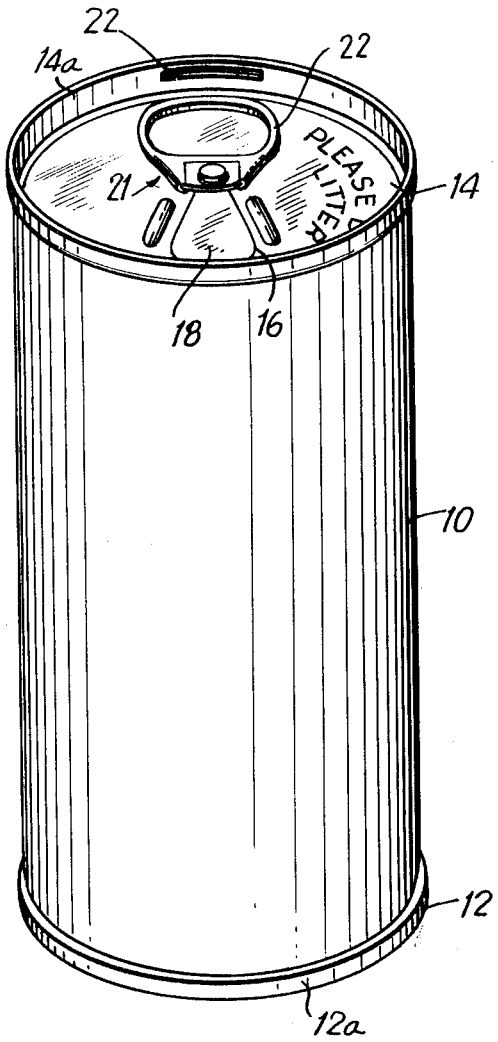
FIG. 1 is a front view isometric representation of a can construction according to the present invention.

Referring to the drawings, FIG. 1 shows a can construction comprising a main body portion 10, a base portion 12 and a lid portion 14. According to construction techniques used presently in the art, body portion 10 is formed of sheet stock, which is rolled into a cylindrical shape and joined at a seam. The base and lid portions are then applied to the ends and crimped over the body portion (FIG. 3) to form the can container. Prior to application of the lid portion to the body portion, it is worked by weakening a tear-shaped outline 16 to form a lid strip 18 and riveting a handle 20 to the center of the lid portion within the outline 16 to form lid segment, generally designated 21.

According to the present invention, lid portion 14 is further worked by machining a generally rectangular opening 22 into the upstanding lip **14*a* formed by lid portion 14. As a recommendation, rather than a restriction, the opening should be in the upper half of the lip to avoid weakening the seal of the can. The size of the opening is just large enough to fit lid strip 18 therethrough comfortably but smaller than the edge cross-sectional dimensions of handle 20. The opening should be formed on the side of lip 14*a* opposite to the placement of lid strip 18**.

In order to provide a more complete description of the present invention, a series of construction and operational steps will now be provided:

A can construction according to the present invention is formed by sheeting metal stock in a width roughly equivalent to the expected height of the can. The metal sheet stock is then cut at a length equal to $\pi$ times the expected diameter of the can. The cut sheet stock is then formed into cylindrical main body portion 10. In an automated manner, simultaneously, base portion 12 and lid portion 14 are formed with lips **12*a*, 14*a*, respectively. From this point outline 16 is weakened in lid portion 14 and handle 20 is formed and riveted to the center of lid portion 14, but within outline 16. During this stamping and forming process, opening 22 is cut through lip 14*a* and the top of main body portion 10** (FIG. 3) to form the can construction of FIG. 1.

Both base portion 12 and lid portion 14 are then brought to opposite sides of main body portion 10, and their lips **12*a*, 14*a*** crimped thereto.

Figure 2:
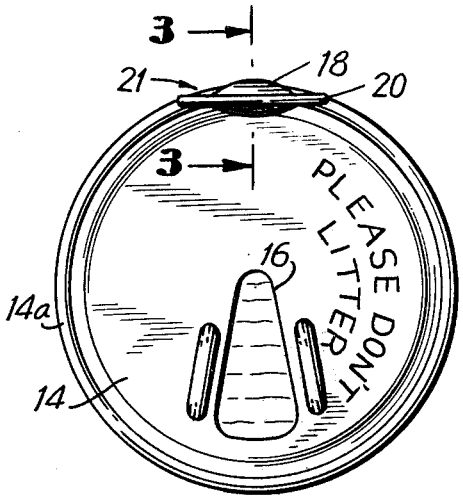
FIG. 2 is a top view representation thereof but showing the lid segment in removed and secured position; and, FIG. 3 is a side, partial, sectional view thereof taken along the line 3—3 of FIG. 2.
Figure 3:
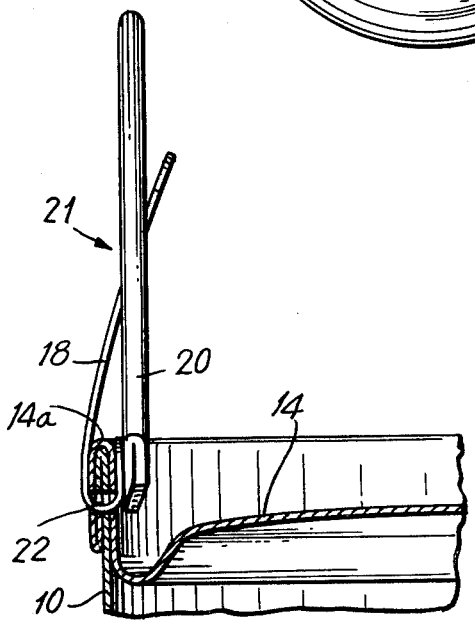

To open the can construction, the lid segment 21 is removed by inserting a finger in handle 20 and lifting, which lifts lid strip 18 from its outline 16. Lid strip 18 is then inserted into opening 22 and bent toward handle 20 to secure it in a manner preventing harmful environmental effects (FIGS. 2 and 3).

Although a can construction according to the present invention has been described and illustrated, the invention is to be limited only by the following claims:

What is claimed is:

1. A can for containing a liquid comprising a cylindrical main body portion, a lid portion including a removable lid segment and an upstanding lip surrounding said lid portion and means provided for securing said segment to said lip after its removal from said lid portion, said lid portion being generally circular with a diameter and a center and said means comprising an opening defined by said lip, said segment extending through said opening after its removal.

2. The invention according to claim 1 wherein said opening is generally rectangular in shape and of specific dimensions and said lid segment is generally rectangular in cross section.

3. The invention according to claim 2 wherein said lid segment comprises a lid strip and a handle, said lid strip being of smaller outside dimensions than said handle, said specific dimensions being respectively larger than said smaller outside dimensions, whereby said lid segment is removable from said lid portion and then secured during emptying of said liquid by insertion of said lid strip through said opening and thereafter further secured by folding said handle toward said lid strip.

4. The invention according to claim 1 wherein said opening is positioned in the upper half of said upstanding lip.

5. The invention according to claim 3 wherein said opening is positioned generally in line with the diameter of the lid portion which goes through said lid strip but on the opposite side of the center of said lid portion.

* * * * *